US006641376B1

(12) United States Patent
Engländer

(10) Patent No.: US 6,641,376 B1
(45) Date of Patent: Nov. 4, 2003

(54) FRICTION VACUUM PUMP

(75) Inventor: Heinrich Engländer, Linnich (DE)

(73) Assignee: Leybold Vakuum GmbH, Cologne (DE)

( * ) Notice: Subject to any disclaimer, the term of this patent is extended or adjusted under 35 U.S.C. 154(b) by 0 days.

(21) Appl. No.: 09/807,058

(22) PCT Filed: Jul. 28, 1999

(86) PCT No.: PCT/EP99/05395

§ 371 (c)(1),
(2), (4) Date: Apr. 6, 2001

(87) PCT Pub. No.: WO00/20763

PCT Pub. Date: Apr. 13, 2000

(30) Foreign Application Priority Data

Oct. 7, 1998 (DE) ..... 198 46 189

(51) Int. Cl.[7] ..... F04B 17/00

(52) U.S. Cl. ..... 417/363; 417/423.4; 417/244; 415/90; 415/119

(58) Field of Search ..... 417/363, 423.4, 417/424.2, 423.12, 244; 415/90, 119

(56) References Cited

U.S. PATENT DOCUMENTS

| | | | | |
|---|---|---|---|---|
| 4,456,433 A | | 6/1984 | Henning et al. | |
| 4,502,832 A | * | 3/1985 | Becker | 417/423.4 |
| 4,768,921 A | * | 9/1988 | Shinjiro et al. | 415/90 |
| 4,797,062 A | * | 1/1989 | Deters et al. | 415/90 |
| 4,806,075 A | * | 2/1989 | Osterstrom et al. | 415/170 R |
| 5,028,219 A | | 7/1991 | Schuetz et al. | |
| 5,069,603 A | | 12/1991 | Schuetz et al. | |
| 5,165,872 A | * | 11/1992 | Fleischmann et al. | 417/423.4 |
| 5,662,456 A | * | 9/1997 | Englander | 415/90 |
| 5,895,202 A | * | 4/1999 | Dauvillier | 415/90 |
| 2001/0012488 A1 | * | 8/2001 | Ohtachi et al. | 417/423.4 |

FOREIGN PATENT DOCUMENTS

| | | | |
|---|---|---|---|
| DE | 22 15 473 | 10/1973 | |
| DE | 80 27 697 U1 | 4/1982 | |
| DE | 32 04 750 A1 | 8/1983 | 417/423.4 |
| EP | 0 412 476 | 2/1991 | |
| EP | 0 748 940 | 12/1996 | |
| FR | 2 310 481 | 12/1976 | |
| GB | 2 085 525 | 4/1982 | |
| JP | 61-294191 | 12/1986 | |

* cited by examiner

*Primary Examiner*—Cheryl J. Tyler
(74) *Attorney, Agent, or Firm*—Fay, Sharpe, Fagan, Minnich & McKee, LLP

(57) ABSTRACT

A molecular vacuum pump (1) has a stator unit (9) and a rotor unit (8) disposed within a housing (2). A narrow gap is maintained during operation between the stator unit (9) and the rotor unit (8). The stator unit (9) and the rotor unit (8) are coupled together with respect to vibration to form a rotor/stator system (3). Elastic vibration elements (4, 5) mount the rotor/stator system in the housing such that the rotor/stator system rotates as a unit relative to the housing. Because the rotor and stator units vibrate together rather than relative to each other, very small, precise tolerances are maintained between them.

16 Claims, 2 Drawing Sheets

FRICTION VACUUM PUMP

BACKGROUND OF THE INVENTION

The present invention relates to a molecular vacuum pump, which has a stator, a rotor, and a housing, and in which, during operation, a narrow gap is maintained between the stator and the rotor. The pumping characteristics of such pumps depend significantly on the size of the gap between the rotor and the stator.

Molecular vacuum pumps are typically constructed using an elastic connection between the stator and the rotor to prevent transfer of vibrations between the stator and the rotor. The shaft bearings are typically supported by elastomer rings in the housing. For example, German publication DE-U-80 27 697 discloses a rotor equipped with a spindle bearing, and completely supporting the rotor/spindle assembly in the housing by O-rings.

The stator/rotor gap of prior art molecular vacuum pumps did not fall below a few tenths of a millimeter, because this is the minimum tolerance practically obtainable using the elastomer coupling of the prior art.

The present invention contemplates a new molecular pump design which accommodates tighter stator/rotor gaps than is possible by the prior art methods.

SUMMARY OF THE INVENTION

According to one aspect of the invention, a stator and a rotor are technically coupled, relative to vibration, and the coupled stator and rotor are jointly fastened in a housing via vibration elements. "Technically coupled, relative to vibration" shall mean that the rotor unit and the stator unit undergo essentially identical vibrations, so that significantly smaller gaps are practical between the stator and the rotor components than has been achieved by prior art designs. The joint vibrations of the coupled stator and rotor are absorbed by the vibration elements, by means of which the coupled stator and rotor are supported in the housing.

Preferably, the coupling between the rotor and the stator is a rigid coupling, whereby the size of the gap between the rotor and the stator is limited solely by the tolerances of the extruded and machine-produced components. These tolerances are sufficiently low that substantially lower gap tolerances are obtainable versus prior art designs which utilized elastomers.

For reasons of functional efficiency, it is frequently not possible to realize a rigid coupling. In such instances, there are preferably one or more vibration elements arranged between the stator unit and the rotor unit, whereby relative vibrational movements therebetween are permitted. The maximum amplitude of such vibrational movements is, however, substantially reduced compared with prior art designs, because the determinative joint vibrational movements of the stator and the rotor are absorbed by the vibration elements supporting the stator and rotor combination in the housing. A drastic reduction in the gap between the stator and the rotor components versus the prior art designs is therefore still achieved.

For example, the O-rings between the stator and the rotor units can be significantly more rigid than the outer vibration elements. Taking into consideration the respective vibrating masses, a vibrational amplitude ratio of 20:80 is achieved thereby.

Other advantages of the invention will be evident to those of ordinary skill in the art from the examples described in the following detailed description and the attached drawings.

BRIEF DESCRIPTION OF THE DRAWINGS

The invention may take form in various components and arrangements of components, and in various steps and arrangements of steps. The drawings are only for the purposes of illustrating preferred embodiments and are not to be construed as limiting the invention.

DETAILED DESCRIPTION OF THE PREFERRED EMBODIMENTS

Figure 1:
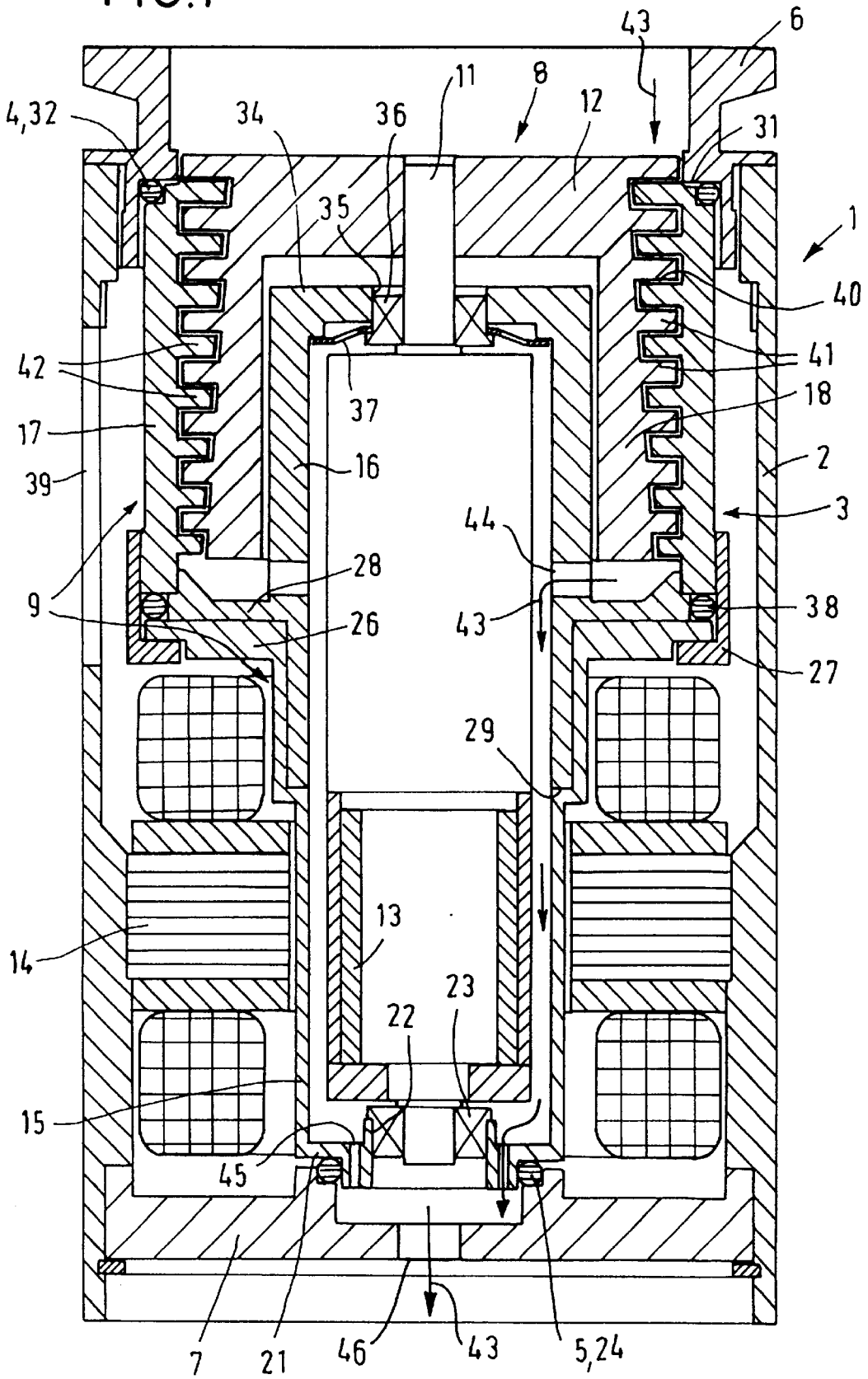
FIG. 1 shows a longitudinal sectional view taken through a turbo-molecular pump formed in accordance with a first embodiment of the invention.
Figure 2:
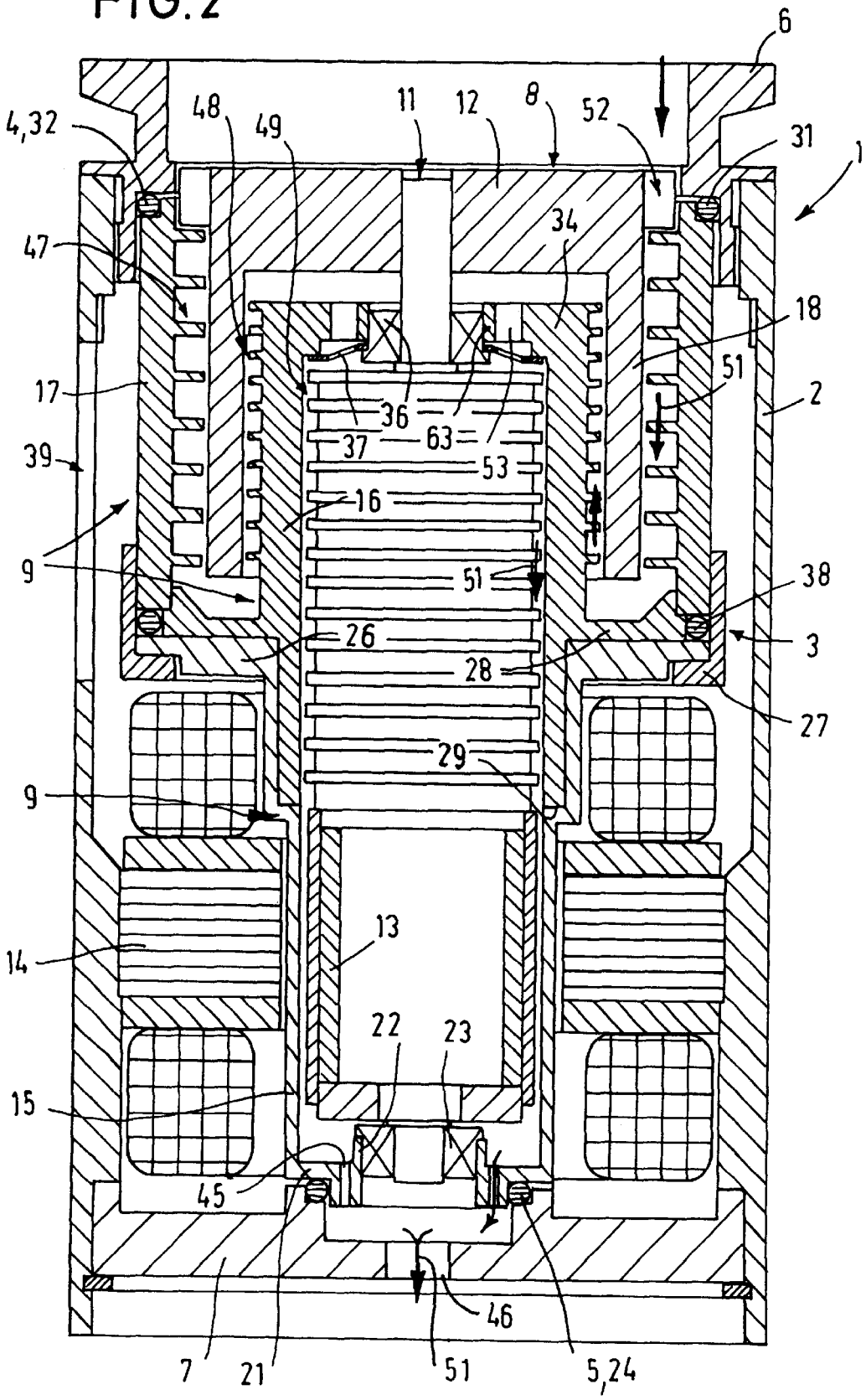
FIG. 2 shows a sectional view taken through a molecular vacuum pump formed in accordance with a second embodiment of the invention.

With reference to FIGS. 1 and 2, the two illustrated embodiments of a pump 1 include an outer housing 2. Arranged within the housing 2 is a rotor/stator system. 3, which is supported in the housing 2 by a first vibrational element 5 and by a second vibrational element 4. A connection flange 6 is disposed on the suction side of the housing 2, and a connection lid 7 is disposed on the pressure side of the housing 2. The rotor/stator system 3 includes a rotor unit 8 and a stator unit 9.

The rotor unit 8 includes a central shaft 11 which supports an essentially bell-shaped rotor 12. On the pressure side, the central shaft 11 has an armature 13 of the driving motor arranged thereon. The housing 2 supports a stator 14 of the driving motor.

The stator unit 9 includes three sleeve components: a first sleeve 15, a second sleeve 16, and a third sleeve 17. The first sleeve 15 is arranged on the pressure side. The second and the third sleeves 16 and 17 are arranged on the suction side. The second sleeve 16 is arranged inside of a wall 18 of the bell-shaped rotor 12, while the third sleeve 17 is arranged outside of the wall 18. The end of the sleeve 15 closest to the pressure side is equipped with an inwardly oriented edge 21, whose interior side forms a sliding fit 22 for a first shaft bearing 23 which is located on the pressure side of the shaft 11. Additionally, the edge 21 of the sleeve 15 forms a receiving region which receives a first O-ring 24, which is preferably made of an elastomer material. A corresponding receiving region is formed at the connection lid 7, and the connection lid 7 is in turn connected to the housing 2. The receiving regions include grooves, angles, or the like which are preferably designed so that the first O-ring 24 serves both as a sealing element and as the first vibration element 5. That is, the first vibration element 5 which supports the rotor/stator system 3 on the pressure side is preferably one and the same element as the first sealing O-ring 24, as shown in FIGS. 1 and 2. Of course, other elements such as radial packing rings, flat rings, or piston seals may be substituted for the first O-ring 24.

The first sleeve 15 also includes, on the suction side, an outwardly oriented edge 26 which cooperates with the second and the third sleeves 16 and 17 to form an interior vacuum-tight housing. A cover nut 27 is inserted over the pressure side of the first sleeve 15 and threads onto the third sleeve 17. The cover nut 27 braces together the outwardly oriented edge 26 of the first sleeve 15 and an outer edge 28 of the second sleeve 16.

The connection flange 6 includes, on the suction side, an inwardly directed step 31 which receives a second O-ring 32. A corresponding receiving region is disposed on the suction side of the third sleeve 17 for receiving the second O-ring 32. In addition to providing sealing, the second O-ring 32 is preferably one and the same element as the second vibration element 4 which supports the rotor/stator system 3 in the housing 2. The housing 2 forms, in cooperation with the lid 7 and the connection flange 6, a clamping shell that tightens together the rotor/stator system 3. With appropriate dimensioning, the housing 2 and the connection flange 6 may be integrally formed as a single piece. The second sleeve 16 is supported therewithin on a step-like ledge 29 of the first sleeve 15.

The suction end of the second sleeve 16 is equipped with an inwardly oriented edge 34, whose interior side forms a sliding fit 35 for a second shaft bearing 36 which is located on the suction side of the shaft 11. In addition, there is arranged in this area an annular spring 37 which generates the required bearing pitch forces.

In the embodiments shown in FIGS. 1 and 2, the rotor unit 8 and the stator unit 9 are rigidly coupled together by the first and second bearings 23 and 36 and by the sliding fits 22 and 35. This rigid coupling provides the desired reduction in play between the stator and the rotor. The rotor/stator system 3 is supported in the housing 2 by the first and second vibration elements 5 and 4. In the embodiments shown, vibration elements 4, 5 are advantageously O-rings which simultaneously assume sealing functions, cooperatively forming a vacuum-tight separation between gas compartments inside the housing 2 and the outside atmosphere. Preferably, a third O-ring 38 surrounds the outer circumference of the outer edge 28 of the second sleeve 16, so that vacuum sealing is assured also in the area of the cover nut 27. Thus, the stator unit 9 forms, for all practical purposes, a second interior housing which is vacuum-tight. As a result, the housing 2 can be fitted with air slots 39.

Having discussed the common features of the exemplary embodiments of FIGS. 1 and 2, reference is made next particularly to the first embodiment shown in FIG. 1.

With particular reference to FIG. 1, a single-stage turbomolecular vacuum pump 1 is shown, with a single gas compartment 40 that tapers from the suction side toward the pressure side. Rows of stator blades 42 extend inwardly from the outer sleeve 17, while rows of rotor blades 41 extend outwardly from the outer surface of the rotor wall 18. The path of transported gases through the pump 1 is denoted by arrows 43. Gases enter via the connection flange 6 into the gas compartment 40 which is equipped with the rotor blades 41 and the stator blades 42. The gases then pass through openings 44 in the second stator sleeve 16, travel along the shaft 11 and through openings 45 in the edge 21 of the first sleeve 15, and finally arrive at the discharge opening 46.

With reference now to FIG. 2, the second exemplary illustrated embodiment of the invention will now be described. FIG. 2 shows a three-stage molecular pump. The interior side of the third stator sleeve 17 is equipped with a threading 47, and the exterior side of the second stator sleeve 16 is equipped with a threading 48. Threadings 47 and 48 cooperate with the cylindrical rotor wall 18 to produce the desired gas transport, in the illustrated orientation downward through threads 47 and upward through threads 48. The exterior side of the shaft 11, which has an enlarged diameter in the region of the second stator sleeve 16, is also equipped with a threading 49 and cooperates with the interior side of the second stator sleeve 16 to form the third pumping stage.

The path of transported gases is identified by arrows 51. The transported gases enter into the outer first pumping stage via the connection flange 6. Preferably, there exists ahead of the outer first pumping stage a filling stage 52 which includes a crown of blades. After passing through the outer first pumping stage, the gases enter the second pumping stage which is disposed between the rotor wall 18 and the second stator sleeve 16. Gases flow in a transport direction which is opposite to the direction of flow in the first pumping stage. The gases experience another change of direction as they pass from the second pumping stage through openings 53 in the edge 34 of the second stator sleeve 16. After passing through openings in the spring 37, the gases enter the third pumping stage. Upon exiting the third pumping stage, the gases pass through openings 45 in the edge 21 of the first sleeve 15, and finally arrive at the discharge opening 46.

The embodiment shown in FIG. 2 can easily be converted to a single-stage molecular vacuum pump. The conversion involves removing the third stator sleeve 17, the rotor bell 18, and the cover nut 27, whereupon only the third pumping stage would exist and be operative. In this single-stage design, the edges 26 and 28 as well as the threading 48 may preferably be eliminated. Also, the diameter of the vibration-and-sealing element 4, 32 and of the front of the second sleeve 16 would be made to essentially match so that the rotor/stator system 3 is supported elastically by housing 2 and connection lid 7.

In the first exemplary embodiment shown in FIG. 1, the stator unit 9 and the rotor unit 8 are, relative to vibration, rigidly coupled with each other at slide fits 22 and 35. In the second exemplary embodiment shown in FIG. 2, there is arranged between the second shaft bearing 36 and the interior side of the,edge 34 of the second stator sleeve 16 an O-ring 63. O-ring 63 has a significantly smaller diameter as compared with the first and the second O-rings 24 and 32. The O-ring 63 serves to accommodate play in the fit, and does not have any significant influence in determining the gap between the rotor and the stator unit.

The disclosed invention is particularly applicable to small turbo-molecular pumps. With decreasing pump size, there is an increase in undesirable gas backflow relative to the forward transport of gas through the pump, and this leads to a disproportionate deterioration in pumping performance. The disclosed invention enables reduction of the gaps between the rotor and the stator through improved pump designs in accordance with the invention, which will improve the pumping performance. Alternatively, the invention permits design of smaller pumps with performance equivalent to a larger pump built using the designs of the prior art. Another advantage of the invention is a reduction in the number of manufacturing parts.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A molecular vacuum pump comprising:

a rotor/stator system including:

a stator unit;

a rotor unit, the rotor and stator units interacting to pump molecules, a narrow gap being maintained between the rotor unit and the stator unit during operation, the rotor unit and the stator unit being coupled rigidly to each other relative to vibration; and a housing that contains the rotor/stator system fastened therein by vibration elements.

2. The vacuum pump as set forth in claim 1, further including:

a mechanical bearing coupling the stator unit and the rotor unit.

3. The vacuum pump as set forth in claim 2, wherein the coupling between the rotor unit and the stator unit further comprises:

an axial slide fit arranged between the bearing and at least one of the rotor unit and the stator unit.

4. The vacuum pump as set forth in claim 2, wherein:

an O-ring is disposed between the bearing and the stator unit, whereby play in the fit therebetween is accommodated.

5. The vacuum pump as set forth in claim 1, further comprising:

a connection flange disposed on the suction side of the housing; and a connection lid disposed on the pressure side of the housing, which together with the housing and the connection flange form a clamping shell that tightens together the rotor/stator system.

6. The vacuum pump as set forth in claim 5, wherein the rotor unit further comprises:

a rotor; and a central shaft connected with the rotor and supported within the housing by the bearing.

7. The vacuum pump as set forth in claim 6, wherein:

the stator unit includes a plurality of sleeves;

the vibration elements are received by receiving regions which are integrally formed into the sleeves of the stator; and the vibration elements support the rotor/stator system in the housing.

8. The vacuum pump as set forth in claim 7, wherein:

the stator unit forms a second interior housing.

9. The vacuum pump as set forth in claim 6, wherein:

the rotor has an essentially bell shape; and the pump includes three pumping stages.

10. The vacuum pump as set forth in claim 1, wherein:

the rotor unit includes a filling stage disposed at a suction end thereof.

11. A molecular vacuum pump comprising:

a stator unit that forms an interior housing that is vacuum tight;

a rotor unit including a rotor arranged in the interior housing and a central shaft connected therewith, a narrow gap being maintained between the rotor unit and the stator unit during operation, the rotor unit and the stator unit being coupled to each other relative to vibration; and a housing equipped with air slots and in which the stator unit is mounted by vibration elements.

12. A molecular vacuum pump comprising:

a rotor/stator system including:

a rotor unit including an essentially bell-shaped rotor and a central shaft connected therewith, and a stator unit including a first sleeve arranged on a pressure side of the vacuum pump, a second sleeve arranged on a suction side of the vacuum pump and inside of a wall of the rotor, and a third sleeve arranged on the suction side of the vacuum pump and outside of the wall of the rotor;

a narrow gap being maintained between the rotor unit and the stator unit during operation, the rotor unit and the stator unit being coupled to each other relative to vibration; and a housing that contains the rotor/stator system coupled therein by vibration elements.

13. The vacuum pump as set forth in claim 12, further including:

an outwardly oriented edge disposed on the suction side of the first sleeve; and an outer edge arranged on the pressure side of the second sleeve; and a cover nut which inserts over the pressure side of the first sleeve and threads onto the third sleeve, and which braces together the outwardly oriented edge of the first sleeve and the outer edge of the second sleeve.

14. A vacuum pump comprising:

a vacuum tight housing having a suction port and a pressure port;

a rotor/stator system including a rotor and a stator, rotation of the rotor relative to the stator creating a gas pumping force which pumps gas molecules from the suction port to the pressure port; and a resilient element supporting the rotor/stator system in the housing such that rotation of the rotor relative to the stator pumps gas from the suction port to the pressure port, the resilient element vibrationally isolating the rotor/stator system from the housing.

15. The vacuum pump as set forth in claim 14 further including:

a resilient connection between the rotor and the stator, the resilient connection being stiffer than the resilient element between the rotor/stator system and the housing, such that more vibration isolation is provided between the rotor/stator system and the housing than between the rotor and the stator.

16. A method of pumping a vacuum comprising:

mounting a rotor to a stator with a stiff, rotational interconnection between the rotor and the stator;

elastically suspending the stator in a housing such that the stator is free to vibrate relative to the housing;

rotating the rotor relative to the stator, the rotor and stator cooperatively interacting to pump gas molecules therebetween from a suction inlet to a pressure outlet, rotating of the rotor inducing vibrations, the stiff, rotational interconnection between the rotor and the stator being sufficiently stiff relative to the elastic suspending of the stator in the housing that the rotor and the stator vibrate together as a unit relative to the housing, whereby tolerances are maintained between the rotor and the stator, which tolerances are smaller than a magnitude of the vibration.

* * * * *